US005436651A

United States Patent [19]

Torii et al.

[11] Patent Number: 5,436,651

[45] Date of Patent: Jul. 25, 1995

[54] INK JET PRINTER HAVING ELASTICALLY DEFORMABLE INK SUPPLY TUBE

[75] Inventors: Takuji Torii; Syuichi Morio; Masayuki Ainoya; Kazunobu Hayashi; Takao Matsuoka; Toshio Fuji; Ryoji Yabuki, all of Katsuta, Japan

[73] Assignee: Hitachi Koki Co., Ltd., Tokyo, Japan

[21] Appl. No.: 965,443

[22] Filed: Oct. 23, 1992

[30] Foreign Application Priority Data

Oct. 28, 1991 [JP] Japan ..... 3-281343

[51] Int. Cl.[6] ..... B41J 2/19

[52] U.S. Cl. ..... 347/88; 347/92

[58] Field of Search ..... 346/140 R; B41J 2/175, B41J 3/04; 347/84, 85, 87, 88, 92

[56] References Cited

U.S. PATENT DOCUMENTS 2,667,402 1/1954 Traugott ..... 346/140 R
4,149,172 4/1979 Heinzl et al. ..... 346/140 R
4,383,263 5/1983 Ozawa et al. ..... 346/140 R
4,490,731 12/1984 Vaught ..... 346/140 R
5,237,342 8/1993 Saikawa et al. ..... 346/140 R

FOREIGN PATENT DOCUMENTS 59-225960 12/1984 Japan .

*Primary Examiner*—Benjamin R. Fuller
*Assistant Examiner*—Alrick Bobb
*Attorney, Agent, or Firm*—Sughrue, Mion, Zinn, Macpeak & Seas

[57] ABSTRACT

A hot-melt type ink jet printer includes a nozzle array, an ink tank containing a hot-melt ink therein, and an ink supply tube connecting the ink tank and the nozzle array, wherein a hot-melt ink is used which is a solid at room temperature but liquifies when heated. The ink supply tube is made of an elastic material that contracts and deforms corresponding to contractions and deformations of the ink contained in the ink supply tube. A cap is attached to the tip end of the ink supply tube so that the inlet of the ink supply tube that is in the ink tank faces to the side or upward.

5 Claims, 2 Drawing Sheets

INK JET PRINTER HAVING ELASTICALLY DEFORMABLE INK SUPPLY TUBE

BACKGROUND OF THE INVENTION

1. Field of the Invention

This invention relates generally to an ink jet printer that uses hot-melt ink. More particularly, the invention relates to an ink jet printer having an ink supply tube which connects a nozzle array and an ink tank wherein the ink supply tube is made of an elastic material that contracts and deforms corresponding to the contractions and deformations of hot-melt ink contained in the ink supply tube when the ink is solidified.

2. Description of the Prior Art

In conventional ink jet printers such as that disclosed in U.S. Pat. No. 4,785,315, an ink supply tube for supplying ink from an ink tank to a nozzle array is made of a rigid material such as metal or plastic and the inlet of the tube into which ink from the ink tank enters faces down.

The ink used in hot-melt type ink jet printers is a solid at room temperature but liquifies when heated. Ink jet printers heat the ink and eject the liquified ink onto paper or another recording medium. These printers have no restrictions on the printing medium, are easy to use, and for these reasons are gaining attention as an effective method of printing.

One drawback of conventional printers occurs when liquid-phase ink solidifies after the heater for the nozzle array and the ink tank is switched off. When the ink solidifies attendant to lowering of the ink temperature to room temperature, its volume contracts and its shape deforms causing air to penetrate between the solidified ink and the walls and bottom of the ink tank and into cracks that form in the solidified ink. When the ink is reheated and melted to a liquid-phase, the air transforms into air bubbles in the liquified ink. With conventional ink jet printers, these air bubbles enter the tube that supplies ink from the ink tank to the nozzles. As a result, when the drive element for ejecting ink applies pressure to the ink by inwardly deforming the wall of the ink tank, the air bubbles in the ink absorb the pressure, thus hindering the efficient ejection of ink.

Another drawback of conventional ink jet printers occurs when ink contracts and deforms as it solidifies. The rigid ink supply tube of conventional ink jet printers allows air bubbles generated in the ink tank to fill space produced in the ink supply tube by the contracting and deforming ink. These air bubbles appear in the ink supply tube as air between the solidified ink and the wall of the ink supply tube. When the ink is reheated and melted, the trapped air reappears as air bubbles in the ink supply tube. When the printing is carried out in this condition, the air bubbles enter the nozzles, adversely affecting the ejection of ink.

SUMMARY OF THE INVENTION

In view of the foregoing, it is an object of the present invention to prevent air bubbles from entering an ink supply tube and to thus improve the efficiency of an ink-ejection process.

This invention differs from conventional ink jet printers in that the ink supply tube is made of an elastic, airtight and heat-resistant resin, such as a fluorine contained resin. Also the ink inlet of the ink supply tube faces the sides of the ink tank or is directed up, rather than down.

The ink supply tube, being made of an elastic resin, contracts and deforms with the solidifying ink, thus preventing air bubbles generated in the ink tank from entering the ink supply tube. Consequently no air bubbles are generated in the ink within the ink supply tube when the ink is reheated, so that ink is efficiently ejected from the nozzles.

Because the ink inlet of the ink supply tube faces the sides of the ink tank or is directed up, rather than down, air bubbles generated on the bottom or sides of the ink tank bypass the inlet to the ink supply tube and float straight to the surface of the ink rather than travel the indirect path into the ink supply tube inlet.

BRIEF DESCRIPTION OF THE DRAWINGS

The above and other objects, features and advantages of the invention will become more apparent from reading the following description of the preferred embodiment taken in connection with the accompanying drawings in which.

DETAILED DESCRIPTION OF THE PREFERRED EMBODIMENTS

Figure 1:
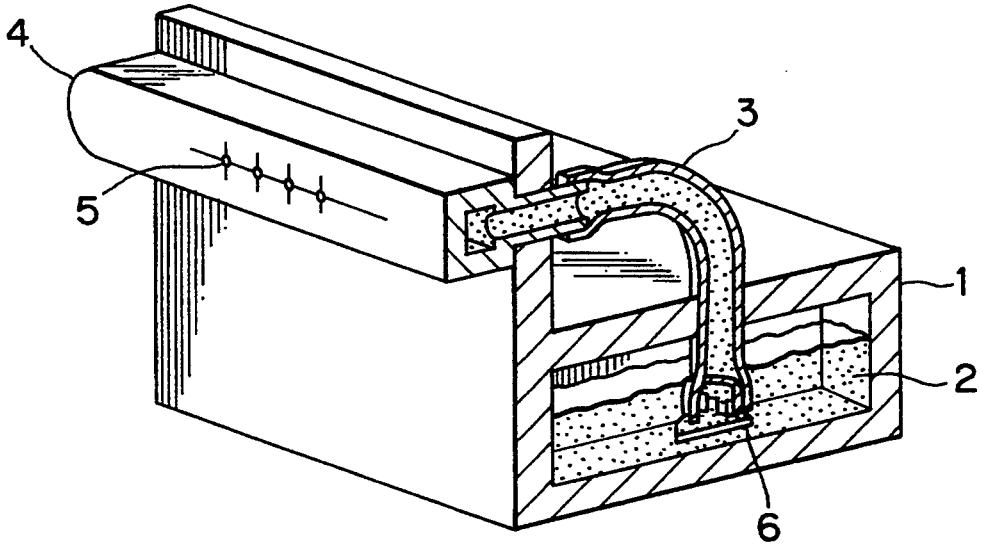
FIG. 1 is a perspective drawing showing a cross-sectional view of a print head of an ink jet printer embodying this invention.

Referring to the accompanying drawings, the following text will describe in detail a preferred embodiment of the invention. FIG. 1 is a perspective drawing showing a cross-sectional view of a print head of an ink jet printer embodying this invention.

In FIG. 1, an ink supply tube 3 connects an ink tank 1 to a nozzle array 4. The nozzle array 4 includes a drive element (not shown in FIG. 1) and a plurality of nozzles 5.

Figure 2:
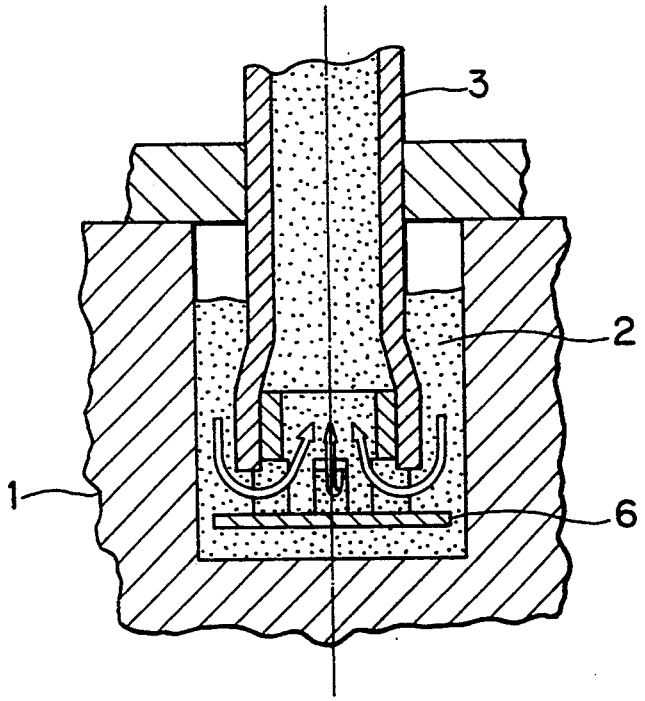
FIG. 2 is an enlarged cross-sectional view showing an inlet portion of an ink supply tube shown in FIG. 1.

FIG. 2 is a cross-sectional diagram showing details of where the ink supply tube 3 and the ink tank 1 connect. As is shown in FIGS. 1 and 2, a plate-like cap 6 is attached to the tip end of the ink supply tube 3 in confronting relation to the tip end thereof. The cap 6 and the tip end of the ink supply tube 3 define an inlet of the ink supply tube 3.

The following text describes an ink-ejection cycle. When a drive element of the nozzle array 4 vibrates, the pressure generated by this vibration ejects ink 2 from the nozzles 5. When ink is ejected, orifice-formed surface deforms inwardly. The force generated when the drive element returns to its initial position and the surface tension produced as the orifice-formed surface revert to a planar condition suck ink 2 from the ink tank 1 into the nozzles 5 through the ink supply tube 3. The volume of the ink 2 sucked into the nozzles 5 replaces the volume of ink 2 previously ejected from the nozzles 5. As the nozzles 5 fill with ink 2, the orifice-formed surface reverts to its initial shape, completing one ink-ejection cycle in a known manner.

The ink supply tubes of conventional ink jet printers are made of rigid materials. The present invention differs in that its ink supply tube 3 is made of a tube of elastic, air-tight and heat-resistant resin, such as a fluorine contained resin, that is 3 mm in diameter and 1 mm thick. Because the ink supply tube 3, being made of an elastic resin, contracts and deforms with the contractions and deformations of the ink 2 as the ink 2 solidifies, no space is created for air bubbles from the ink tank 1 to enter the ink supply tube 3 after the heater is turned off. The ink 2 within the ink supply tube 3 remains free of air even after solidifying. Air bubbles are not thus generated in the ink supply tube 4 when the ink 2 is reheated to melting point because, although the ink 2 expands when reheated to melting point, the ink supply tube 3 deforms while conforming to the increasing volume of the expanding ink 2.

FIG. 2 shows the cap 6 installed to the ink inlet of the ink supply tube 3. In conventional ink jet printers, because the ink inlet of cap 6 faces downward, ink 2 is sucked upward from the bottom of the ink tank 1 into the ink supply tube 3 each time ink 2 is ejected. Air bubbles generated when the ink 2 is heated and melted are often sucked into the ink supply tube 3 along with the ink 2. The cap of the embodiment shown in FIG. 2 is constructed so that the ink inlet of the ink supply tube 3 faces the sides of the ink tank 1. With this construction air bubbles generated on the bottom or sides of the ink tank 1 bypass the inlet to the ink supply tube 3 and float straight to the surface of the ink 2 rather than travel the indirect path into the ink supply tube inlet.

Figure 3:
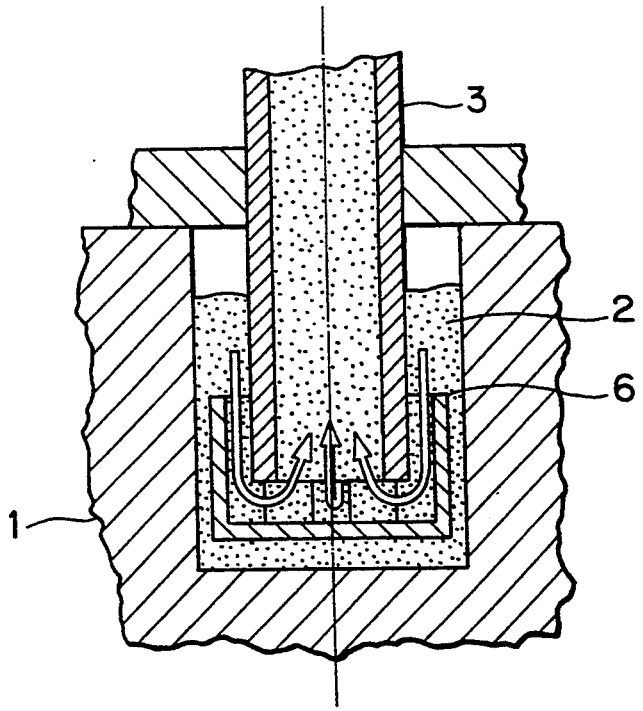
FIG. 3 is a cross-sectional view showing a modified inlet portion of he ink supply tube.

FIG. 3 is a cross-sectional view showing a modification of the cap 6 shown in FIG. 2. In this modification, the cap 6 has a U-shaped cross-section. The tip end of the ink supply tube 3 and the inner side wall and a bottom wall of the cap 6 define the inlet of the ink supply tube 3. The thus defined ink inlet faces up with respect to the bottom surface of the cap 6. With this construction also air bubbles bypass the inlet of the ink supply tube 3 and float from the bottom or sides of the ink tank 1 straight to the upper surface of the ink 2.

The flexible ink supply tube of the present invention expands and deforms according to changes in ink volume as the ink cools and solidifies, thus preventing air bubbles from entering the ink supply tube. Air bubbles are therefore not generated in the ink within the ink supply tube when the ink jet printer is restarted. The present invention further prevents air bubbles from entering the ink supply tube, and moreover from proceeding to the nozzles, by having the ink inlet of the ink supply tube face the sides of the ink tank or up, rather than down, thus preventing bubbles that are generated on the bottom or sides of the ink tank on restarting of the printer from entering as they float from the bottom or sides of the ink tank to the upper surface of the ink.

The present invention eliminates air bubbles from the ink and consequently the effect they have of absorbing pressure changes resulting from deformation of the ink chamber. Ink is therefore more efficiently ejected, increasing the reliability of the ink jet printer and the quality of the characters printed.

What is claimed is:

1. An ink jet printer comprising:

a nozzle array having a plurality of nozzles and a drive element for ejecting ink from selective ones of said nozzles;

an ink tank defined by side walls and a bottom wall and containing a hot-melt ink therein, said ink being of a solid-phase at room temperature and of a liquid-phase when above a melting point, wherein said ink contracts and deforms when the liquid-phase ink is cooled to room temperature;

an ink supply tube having an inlet connected to the ink tank and an outlet connected to said nozzle array for supplying said ink to said nozzle array wherein the inlet of said ink supply tube faces at least one of said side walls of said ink tank; and a cap member attached to a tip end of said ink supply tube, the cap member and the tip end of said ink supply tube defining the inlet of said ink supply tube.

2. The ink jet printer as set forth in claim 1, wherein said cap member is a plate-like member having a surface confronting the tip end of said ink supply tube.

3. An ink jet printer comprising:

a nozzle array having plurality of nozzles and a drive element for ejecting ink for selective ones of said nozzle;

an ink tank defined by side walls and a bottom wall and containing a hot-melt ink therein, said ink being of a solid-phase at room temperature and of a liquid-phase when above a melting point, wherein said ink contracts and deforms when the liquid-phase ink is cooled to room temperature;

an ink supply tube having an inlet connected to the ink tank and an outlet connected to said nozzle array for supplying said ink to said nozzle array wherein the inlet of said ink supply tube faces upward with respect to the bottom wall of said ink tank; and a cap member attached to a tip end of said ink supply tube, the cap member and the tip end of said ink supply tube defining the inlet of said ink supply tube.

4. The ink jet printer as set forth in claim 3, wherein said cap member has a U-shaped cross-section having an inner side wall and a lower wall, the tip end of said ink supply tube, the inner side wall and the lower wall of said cap member defining the inlet of said ink supply tube.

5. The ink jet printer as set forth in claim 4, wherein said lower wall is parallel to said bottom wall.

* * * * *